US009196429B2

(12) United States Patent
Sun

(10) Patent No.: US 9,196,429 B2
(45) Date of Patent: Nov. 24, 2015

(54) CONTACT STRUCTURE FOR ELECTROMECHANICAL SWITCH

(71) Applicant: INTAI TECHNOLOGY CORP., Taichung (TW)

(72) Inventor: Richard Loon Sun, Taichung (TW)

(73) Assignee: INTAI TECHNOLOGY CORP., Taichung (TW)

( * ) Notice: Subject to any disclaimer, the term of this patent is extended or adjusted under 35 U.S.C. 154(b) by 0 days.

(21) Appl. No.: 14/509,067

(22) Filed: Oct. 8, 2014

(65) Prior Publication Data

US 2015/0021149 A1 Jan. 22, 2015

Related U.S. Application Data

(63) Continuation-in-part of application No. 13/204,668, filed on Aug. 6, 2011, now Pat. No. 8,884,726.

(30) Foreign Application Priority Data

Jun. 3, 2011 (TW) ..... 100119622 A

(51) Int. Cl.
*H01H 1/10* (2006.01)
*H01H 1/00* (2006.01)
*H01H 59/00* (2006.01)

(52) U.S. Cl.
CPC ..... *H01H 1/0036* (2013.01); *H01H 1/10* (2013.01); *H01H 2001/0052* (2013.01); *H01H 2001/0084* (2013.01); *H01H 2059/0036* (2013.01)

(58) Field of Classification Search
CPC ..... H01H 1/0036; H01H 2059/0036; H01H 2001/0052; H01H 2001/0084
USPC ..... 200/247, 292, 240, 241, 512, 38 R, 38 E, 200/250, 251; 335/78–86
See application file for complete search history.

(56) References Cited

U.S. PATENT DOCUMENTS 6,307,452 B1 * 10/2001 Sun ..... H01H 59/0009 333/262
6,593,672 B2 * 7/2003 Ma ..... H01G 5/16 307/106
7,348,513 B2 * 3/2008 Lin ..... H01H 13/703 200/512
7,471,031 B2 * 12/2008 Kawakubo ..... H01G 5/16 200/181
2007/0163866 A1 * 7/2007 Tsai ..... H01H 13/702 200/292
2009/0014296 A1 * 1/2009 Weber ..... H01H 1/0036 200/181
2011/0024274 A1 * 2/2011 Yoshihara ..... B81B 3/0021 200/181

* cited by examiner

*Primary Examiner* — Abdullah Riyami
*Assistant Examiner* — Harshad Patel
(74) *Attorney, Agent, or Firm* — CKC & Partners Co., Ltd.

(57) ABSTRACT

The present disclosure discloses a contact structure for electromechanical switch. The contact structure is using the design including a PCB and a moving contact to allow the actuations and have great switch characteristics whose range is from DC to high frequency.

20 Claims, 9 Drawing Sheets

CONTACT STRUCTURE FOR ELECTROMECHANICAL SWITCH

RELATED APPLICATIONS

This application is a continuation-in-part of U.S. patent application Ser. No. 13/204,668, filed on Aug. 6, 2011, which claims priority to Taiwan Application Serial Number 100119622, filed on Jun. 3, 2011. The entire disclosures of both applications are hereby incorporated by reference herein.

BACKGROUND

1. Technical Field

This disclosure relates to an electromechanical switch, more particularly relates to a contact structure for electromechanical switch utilizing a PCB based construction and a moving contact to allow the actuations and have excellent switch performances, such as high isolation and low insertion loss, and the electromechanical switch is capable of transmitting electronic signals ranged from DC to microwave.

2. Description of Related Art

The electronic signal transmission speed is requested growing fast with the technology progress, so that the control switches or relays are required to be capable of processing the 1 GHz or higher frequency signal. The electromechanical switches or relays are for connecting or disconnecting current or circuitry with mechanical design. Conventional contact structure of those electromechanical switches or relays does not consider the problem of high frequency transmission while designing, so that the contact structure is only capable of transmitting DC or extremely low frequency signals. If the present contact structure with mechanical design desires to be added a processing device for high frequency signals, it will meet the problems which are the cost increase in large scale and hard to mass production.

The MEMS switch or relay is used for resolving the problems mentioned above. In brief, it is fabricated on the silicon wafer with semiconductor technology and having the potential of mass production. The micro design is capable of minimizing the volume of the switches or relays. The typical MEMS switch 5, shown as FIGS. 1 and 2, has a pair of electrodes 11 and 14 which are separated by a thin dielectric layer 12 and an air gap or cavity 13 defined by a dielectric standoff 16. The electrode 14 is mounted on a diaphragm or a moving beam capable of mechanical displacement, and the other electrode 11 is jointed on a substrate and cannot move freely. The switch 5 has two states, that is open (shown as FIG. 1) or close (shown as FIG. 2).

The MEMS switch is very small, so that the charged dielectric medium and effects of static friction always interference the stable actuation and release. And the MEMS switch needs low insertion loss and high isolation while transmitting the high frequency electronic signals, so as to define the gap between the electrodes 11 and 14. Therefore, the MEMS switch is restricted while being used for transmitting the high frequency electronic signals.

In addition, the MEMS switch is fabricated with semiconductor technology, and the processes are including repeatedly oxidizing, depositing, transferring, and etching. The processes are complicated and the steps are numerous. If one of the processes is error, the total element must be reworked, so as to make the manufacturing time and cost higher.

SUMMARY

The objective of this disclosure is providing a contact structure for electromechanical switch, which provides stable switch characteristics, such as low insertion loss while ON, and high isolation while OFF.

The contact structure of this disclosure matches the condition of low driving power.

The contact structure of this disclosure allows many kinds of actuations, such as electrostatic force, electro-magnetic force, piezoelectric effect, or heating effect.

The contact structure of this disclosure applies to the switch or relay with the application range from DC to microwave, and is capable of processing the 1 GHz or higher frequency signal.

The contact structure of this disclosure is using PCB structure and suitable for low cost mass production. Compared to conventional MEMS switch, the switch of this disclosure has lower manufacturing cost and simpler manufacturing method.

The contact structure of this disclosure is capable of minimizing the volume of the MEMS switch.

The contact structure of this disclosure utilizes PCB and moving contact. Although the PCB has been already used in RF switch and thin film switch, there are still many characteristics different from the RF switch and the thin film switch, which comprise:

(a) The RF switch is capacitive type, it is not suitable for directing current and cannot be a current switch or relay. But the switch of this disclosure is suitable for being a current switch or relay.

(b) The RF switch is driven by electrostatic force which needs high driving voltage and very small actuation gap that does not match the conditions of low driving power and large separated gap.

(c) The printed circuits of the RF switch are integrated on a PCB, but the contact structure of this disclosure is an individual configuration.

(d) The thin film switch generally means a push switch, not an electromechanical switch, which is suitable for the conditions with a switch power lower than 1 W, 42V (DC) or 25V(DC) maximum operating voltage, minimum operating current smaller than 100 mA. The thin film switch is not suitable for matching conventional electromechanical actuating device, and further not suitable for processing high frequency signal.

In one embodiment, the contact structure of this disclosure is capable of transmitting high frequency signals in a one-in-multi-out, a multi-in-one-out or a multi-in-multi-out mode.

Other features or advantages of the present disclosure will be apparent from the following drawings and detailed description of several embodiments, and also from the appending claims.

BRIEF DESCRIPTION OF THE DRAWINGS

The present disclosure can be more fully understood by reading the following detailed description of the embodiment, with reference made to the accompanying drawings as follows.

DETAILED DESCRIPTION

Figure 1:
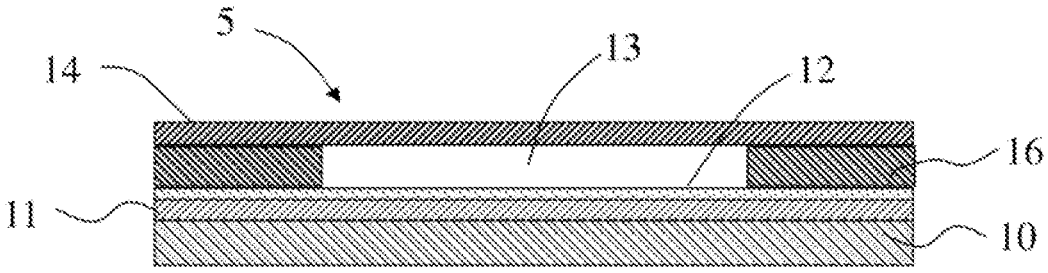
FIG. 1 shows a cross-section diagram of a typical MEMS switch.
Figure 2:
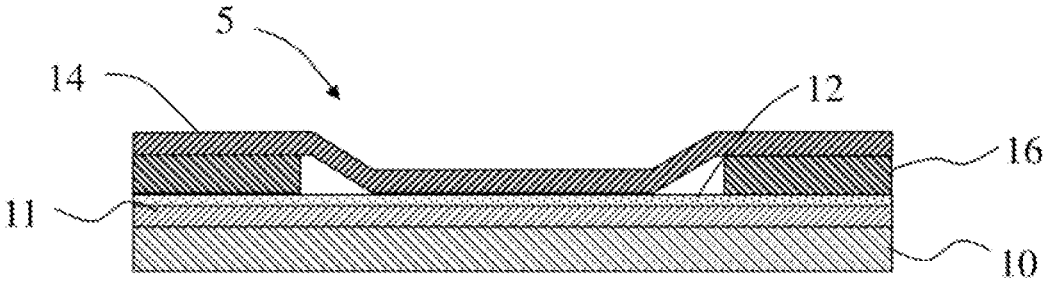
FIG. 2 shows a cross-section and schematic diagram of the typical MEMS switch while being actuated.

Reference will now be made in detail to the present embodiments of the disclosure, examples of which are illustrated in the accompanying drawings. Wherever possible, the same reference numbers are used in the drawings and the description to refer to the same or like parts.

Figure 3:
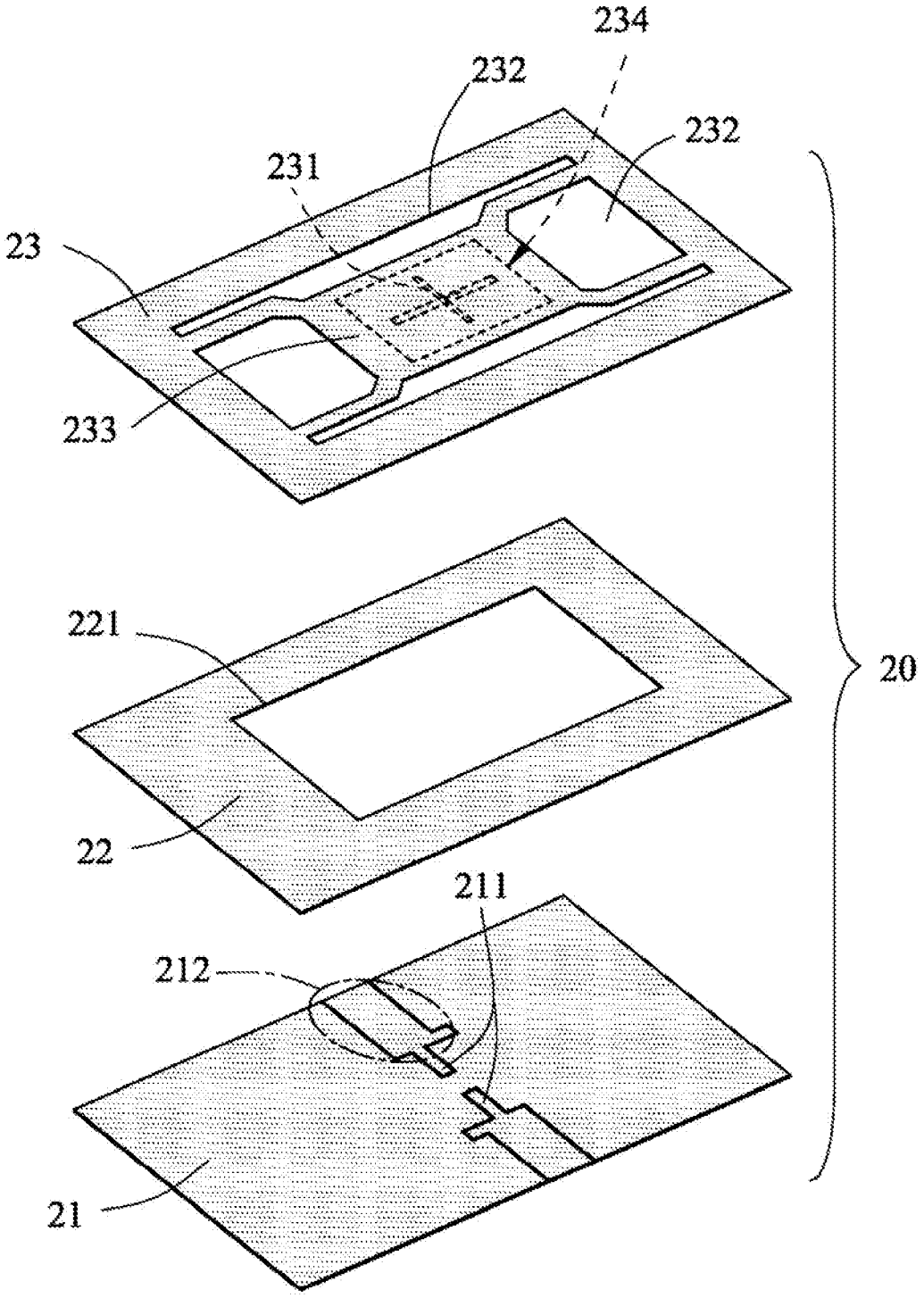
FIG. 3 shows an exploded diagram of the contact structure according to this disclosure.

Please refer to FIG. 3, a contact structure 20 is stacked by a plurality of PCBs, which comprise a basic layer 21, a spacing layer 22, and a top layer 23 from top to bottom.

The basic layer 21 is rigid material but not limited to insulation material, such as FR4, or a material capable of responding microwave with some frequency range, such as RO4003 high frequency circuit board material. A lower surface of the basic layer 21 has a grounding structure (not shown) which is formed by metalizing the lower surface of the basic layer 21. An upper surface of the basic layer 21 is set signal traces by printed circuit technology to become static contacts 211. A static contact 211 is formed on an upper surface of the basic layer 21 via printed circuit technology. The static contact 211 can be viewed as a metal signal trace.

The spacing layer 22 is stacked on the upper surface of the basic layer 21. The spacing layer 22 can be made from various PCB materials, such as kapton, typical FR4, or solid bonding film made from acrylic with a predetermined thickness. The spacing layer 22 includes a window 221 to make the static contacts 211 of the basic layer 21 be not covered by the spacing layer 22.

The top layer 23 is stacked on an upper surface of the spacing layer 22, and made from a flexible circuit board material. A static contact 211 is formed on an upper surface of the basic layer 21 via printed circuit technology. The static contact 211 can be viewed as a metal signal trace. A nick 232 is specifically machined at the flexible circuit board surrounding the moving contacts 231, so that a floating area 233 is surrounding the moving contacts 231. The floating area 233 can be moved downwardly while a force is applied and moved upwardly to become flat while the force is released.

Figure 4:
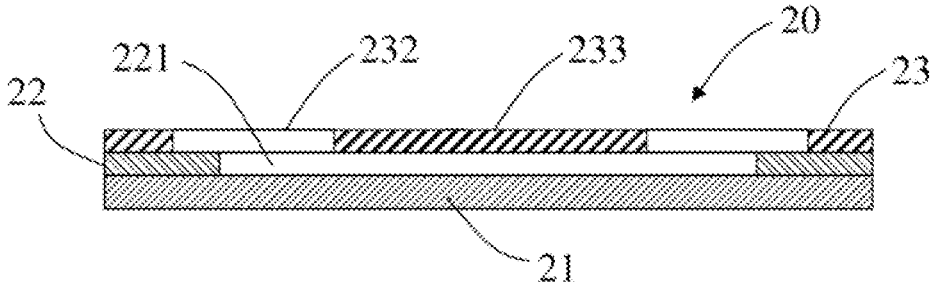
FIG. 4 shows a cross-section diagram of the contact structure according to this disclosure.

Finally, the basic layer 21, the spacing layer 22 and the top layer 23 are stacked together, shown as FIG. 4.

The static contacts 211 and the moving contacts 231 are metal printed conducting paths with specified geometry, which are defined in accordance with different application range. Therefore, the layouts of the paths of the static contacts 211 and the moving contacts 231 are defined according to the performance of the switch or relay. That makes the application range of the contact structure 20 wider. It is suitable for the application range from DC to microwave, especially capable of processing 1 GHz or higher frequency signal, and capable of performing low insertion loss.

The static contacts 211 and the moving contacts 231 have specified impedance, normally 50Ω. The static contacts 211 and the moving contacts 231 are micro strip lines. The micro strip line is a kind of signal transmission line having good impedance control and capable for passing high frequency signals.

Figure 3A:
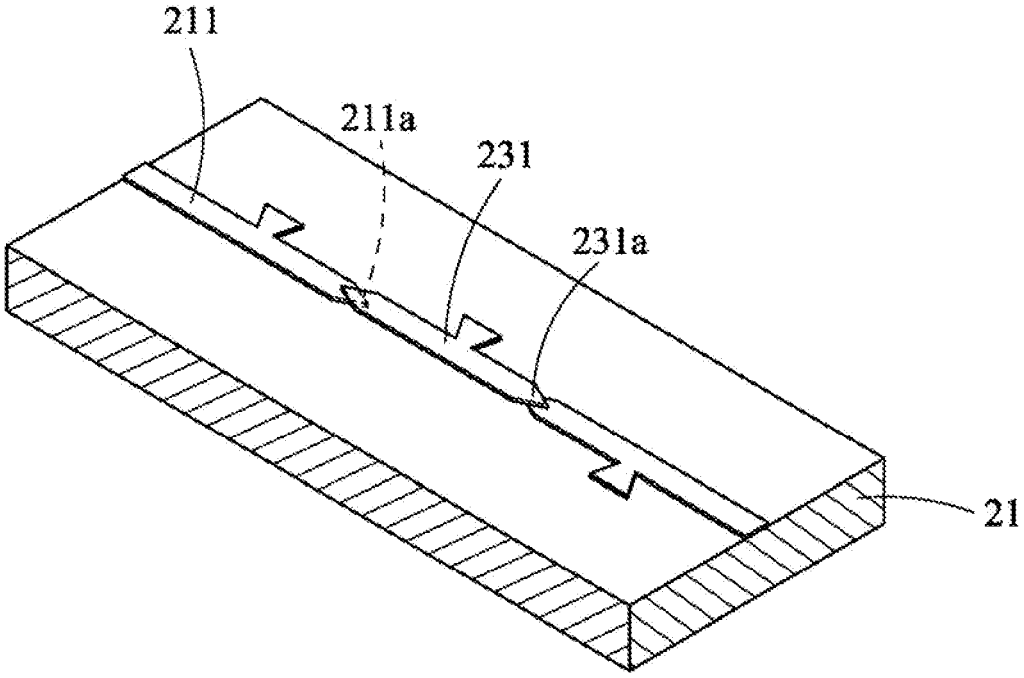
FIG. 3A shows a schematic diagram of one example of the structure of the moving contact and the static contact.
Figure 3B:
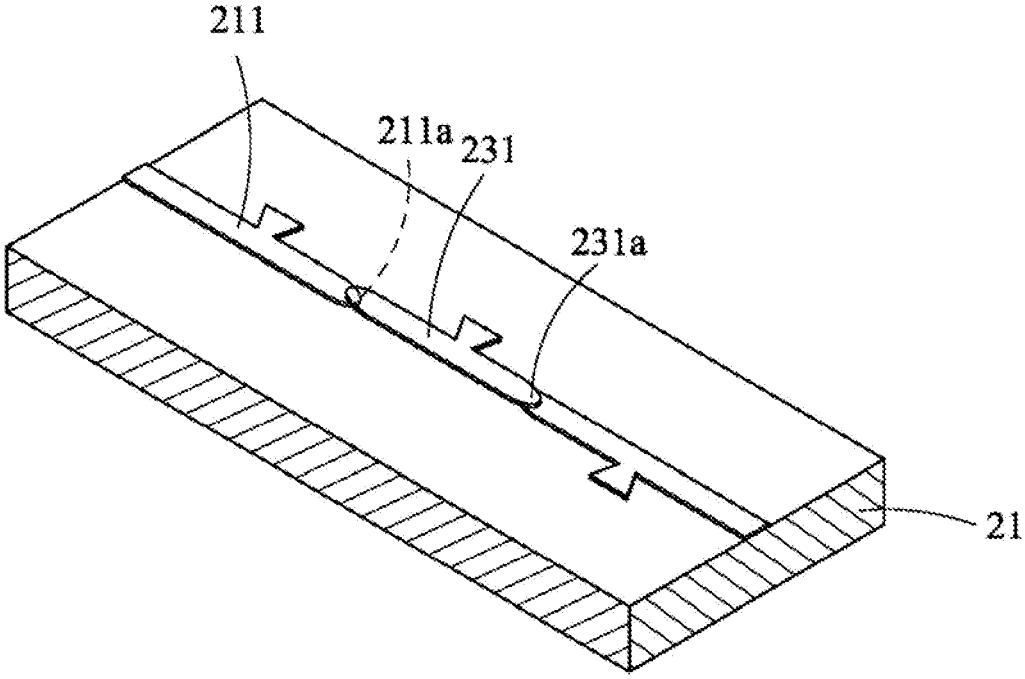
FIG. 3B shows a schematic diagram of another example of the structure of the moving contact and the static contact.
Figure 3C:
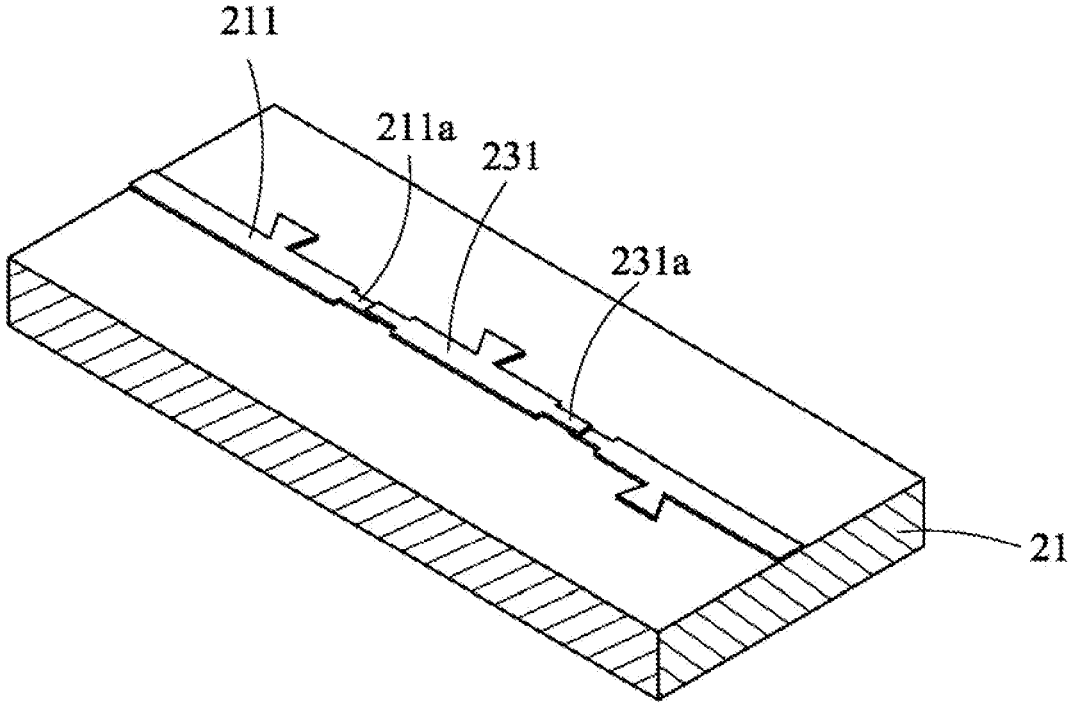
FIG. 3C shows a schematic diagram of still another example of the structure of the moving contact and the static contact.

Commonly when the static contacts 211 and the moving contacts 231 are contacted for conducting a waveguide to transmit signals, an overlapping area is formed. The overlapping area can be referred as a capacitor. At high frequency, signal can couple through the capacitor. Therefore, even the static contacts 211 and the moving contacts 231 are not contacted (switch is OFF), the signal is not isolated. Insufficient isolation will reduce performance of the devices such as switch or relay utilizing the contact structure 20. Owing to the isolation is related to the overlapping area, to minimize the phenomena of insufficient isolation, the overlapping area should be reduced. For example, in FIG. 3A, the static contacts 211 and the moving contacts 231 has converging portion 211*a* and converging portion 231*a* respectively. Via the structure of the converging portion 211 and the converging portion 231, isolation between the static contacts 211 and the moving contacts 231 will be enhanced. It should be known that the geometry of the converging portions 211*a*, 231*a* can be specifically designed in accordance with various situations. For example, in FIG. 3A, the converging portions 211*a*, 231*a* are triangle with spiky end, and in FIG. 3B, the converging portions 211*a*, 231*a* are triangle with circle end. In FIG. 3C, the converging portions 211*a*, 231*a* can be formed by combination of two portions with gradually reduced width. By the converging portions 211*a*, 231*a*, it is possible to keep sufficient isolation and capable of transmitting high frequency signals.

However, the impedance variation occurred owing to line width change of the static contacts 211 and the moving contacts 231. Therefore, a compensation structure is set along the metal printed conducting paths to compensate the impedance variation. In this embodiment, a tuning circuit 212 and a tuning circuit 234 adjacent to the static contacts 211 and the moving contacts 231 are utilized for compensating the impedance variation. The tuning circuit 212 and the tuning circuit 234 have specifically designed geometry for effectively compensating the impedance variation.

The gap between the static contacts 211 and the moving contacts 231 is defined by the thickness of the spacing layer 22 and the required electric power for actuating the contact structure 20. However, the narrow gap is preferable to make sure that the moving contacts 231 are certainly contacting with the static contacts 211 and in a condition of low driving power. The gap can be controlled by controlling the thickness of the spacing layer 22.

Figure 5:
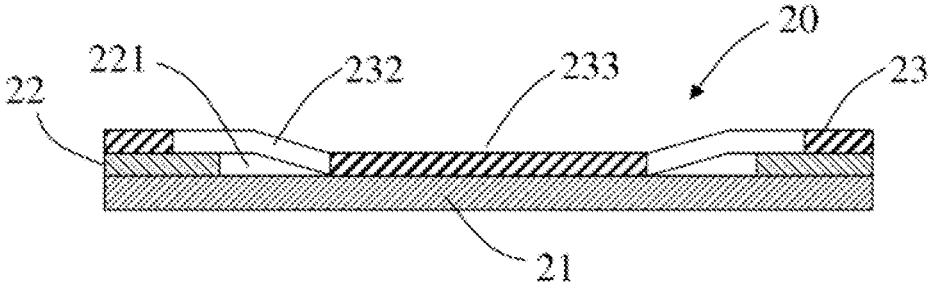
FIG. 5 shows a schematic diagram of the contact structure according to this disclosure while being actuated.

Please refer to FIG. 5, the contact structure 20 with an actuation makes the top layer 23 having the floating area 233 move downwardly, and the window 221 of the spacing layer 22 allows the moving contacts 231 moving downwardly to contact the static contacts 211 of the basic layer 21. The actuation can be performed by an actuating device with electrostatic force, electromagnetic force, piezoelectric effect, or heating effect. The actuating device is coupled to the contact structure 20 and a transmission portion of the actuating device is contacting the top layer 23 having the floating area 233.

Figure 6:
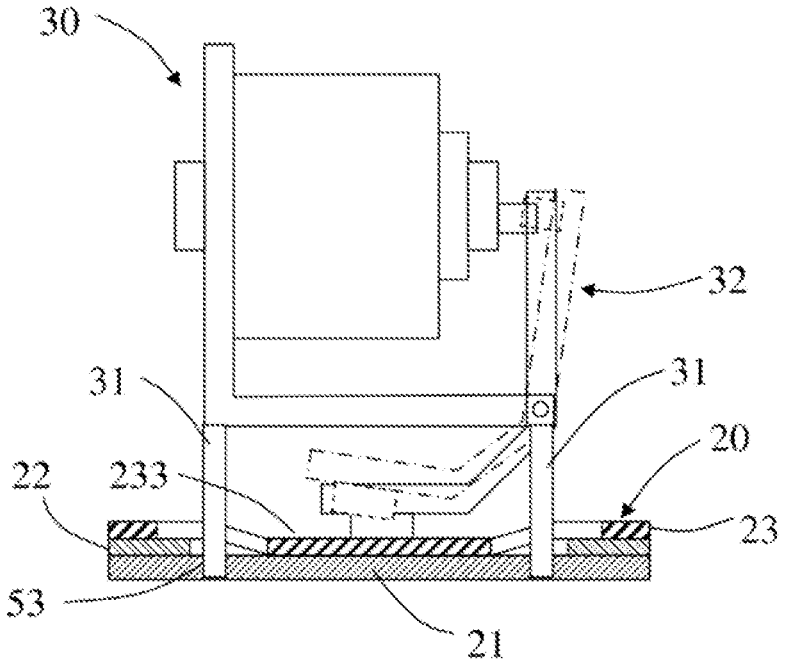
FIG. 6 shows a schematic diagram of a first embodiment of the electromechanical switch with the contact structure according to this disclosure.

Please refer to FIG. 6, the actuating device 30 is electromechanical type. A supporting member 31 is welded to a lead frame 54 disposed at the bottom of the basic layer 21 via the window 221 of the spacing layer 22 and a via 53 disposed at the basic layer 21 in advance. The transmission portion 32 of the actuating device 30 is contacting the top layer 23 having the floating area 233. The movement of the transmission portion 32 is driving the floating area 233 to move downwardly and then makes the moving contacts 231 contact the static contacts 211.

Figure 7:
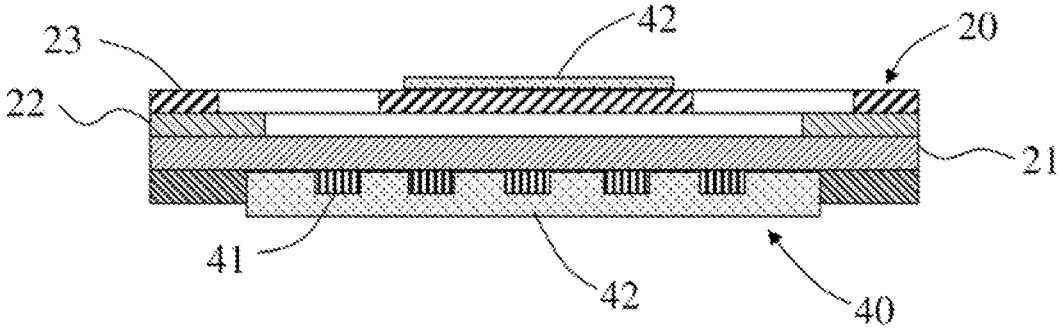
FIG. 7 shows a schematic diagram of a second embodiment of the electromechanical switch with the contact structure according to this disclosure.

Please refer to FIG. 7, the actuating device 40 is electromagnetic type. In the circuit printing process of the contact structure 20, a printed coil 41 is constructed at the bottom of the basic layer 21, and a magnetic material 42 is constructed at the top of the top layer 23 and coating the printed coil 41. The current is passed through the printed coil 41, and the moving contacts 231 are move downwardly to contact the static contacts 211 via the magnetic material 42.

Figure 8:
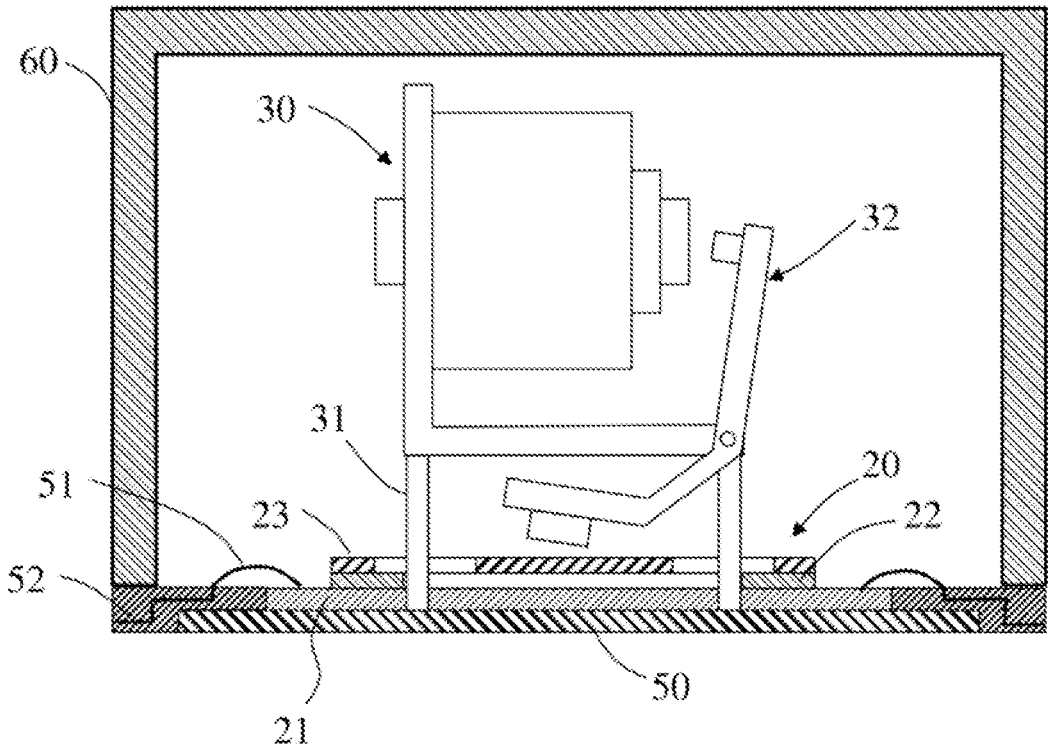
FIG. 8 shows a schematic diagram of a first embodiment while packaging the contact structure and an actuating device according to this disclosure.
Figure 9:
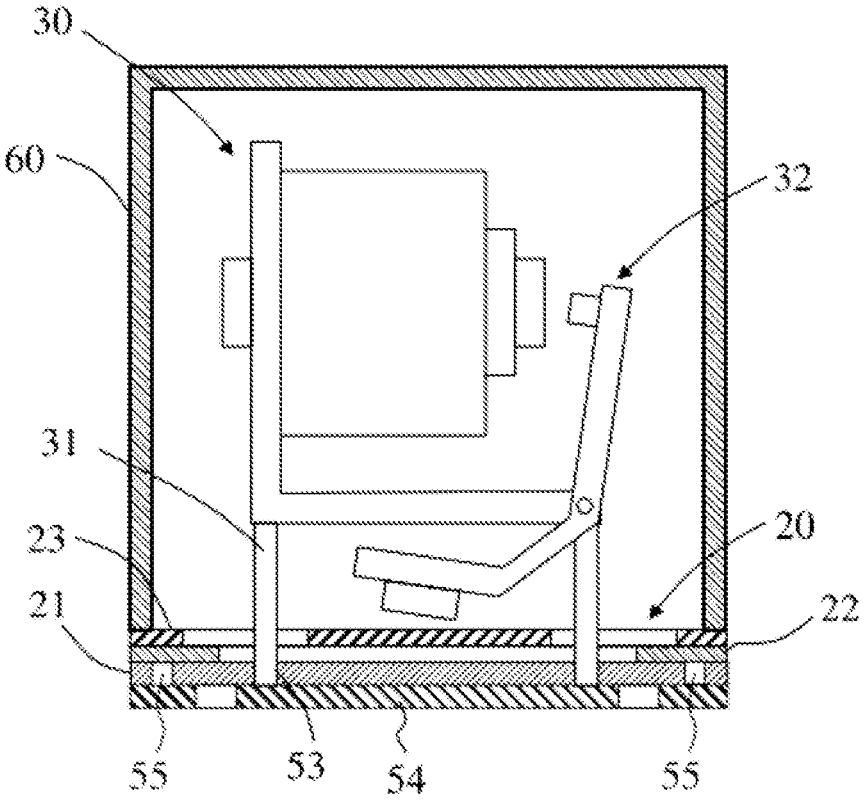
FIG. 9 shows a schematic diagram of a second embodiment while packaging the contact structure and an actuating device according to this disclosure.

Embodiments of packaging processes of the contact structure 20 and the actuating device 30 are showed in FIGS. 8 and 9. The switch structure may not be packaged individually; switch meshes may be formed on the printed circuit board first and the packaging processes are then performed.

Please refer to FIG. 9, the actuating device 30 has already been coupled to the contact structure 20. One part of the contact structure 20 is packaged. The lower surface of the basic layer 21 is presetting layouts of a ground and leads, and the printed conducting paths arranged at the upper surface of the basic layer 21 are connected to relative leads through a via 55 of the basic 21. The basic layer 21 is coupled to a lead frame 54 matched each other. The supporting member 31 of the actuating device 30 is welded at the lead frame 54 through the window 221 of the spacing layer 22 and the preset via 53 of the basic layer 21. An outer cover 60 is closing the whole configuration.

Figure 10:
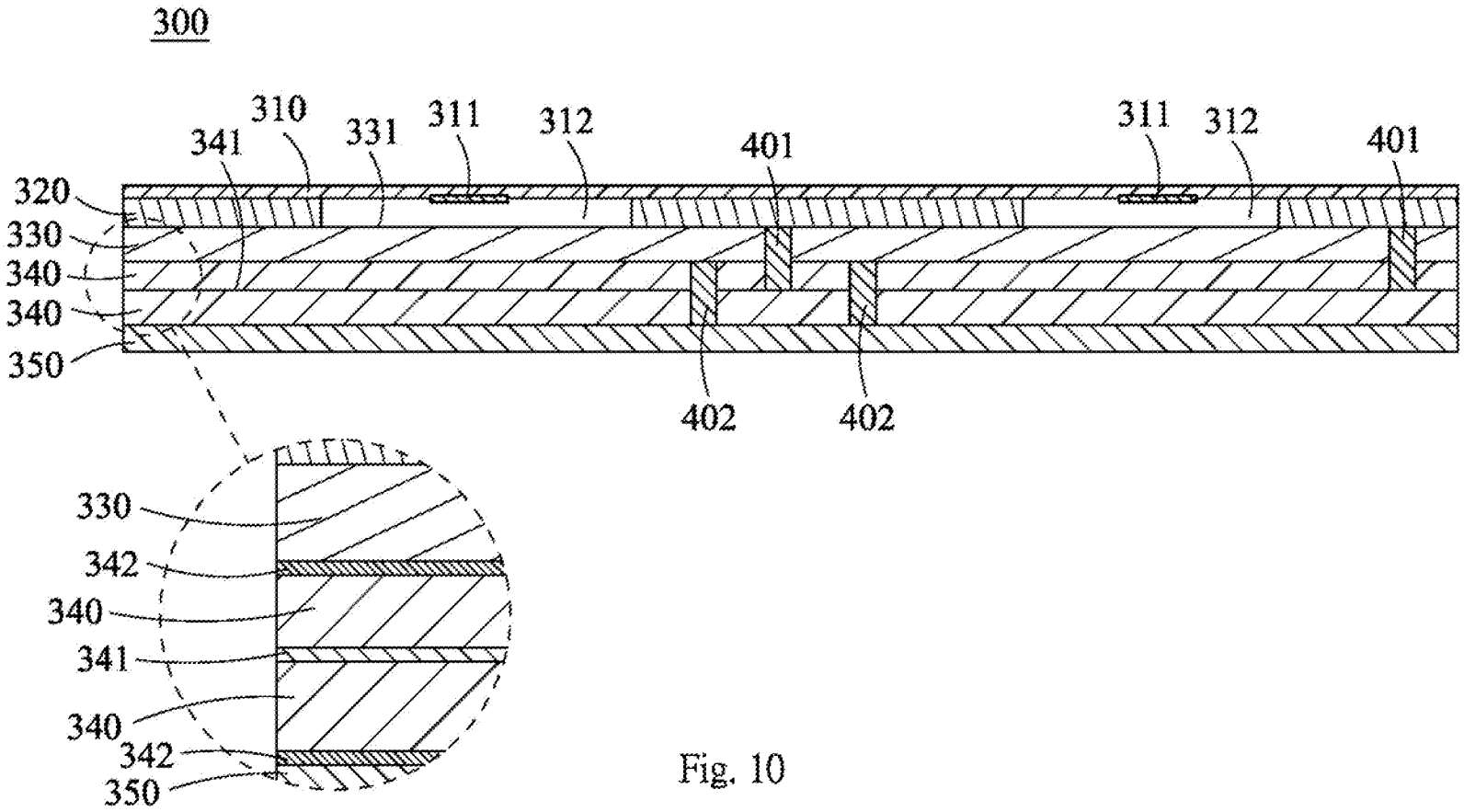
FIG. 10 shows a section view of another embodiment of the contact structure according to this disclosure.

Please refer to FIG. 10. A contact structure 300 is formed by stacking a plurality of PCBs. The contact structure 300 includes a top layer 310, a spacing layer 320, a basic layer 330, at least two RF layers 340 and at least one control layer 350. The top layer 310, the spacing layer 320, the basic layer 330, the RF layers 340 and the control layer 350 are stacked in order from up to down. The structure of the top layer 310, the spacing layer 320 and the basic layer 330 are similar to the top layer 23, spacing layer 22 and the basic layer 21 in the aforementioned embodiment. In the embodiment, a space between the top layer 310 and the basic layer 330 is separated into multiple sub-spaces 312 by the spacing layer 320, and the top layer 310 includes multiple moving contacts 311. In the embodiment, two sub-spaces 312 and two moving contacts 311 are used, but it should be mentioned that the number of the sub-space 312 or the moving contact 311 is not limited. The basic layer 330 includes a static contact 331 on an upper surface, and one of the RF layers 340 includes a trace 341 on an upper surface. The static contact 331 is a micro strip line for allowing transmitting high frequency signals such as RF signals, and the trace 341 is a strip line for RF connection between devices. Main difference between the contact structure 300 and the aforementioned contact structure 20 is that the contact structure 20 is only capable of transmitting the signals in a one-in-one-out mode, but the contact structure 300 is further capable of transmitting the signals in a one-in-multi-out, a multi-in-one-out or a multi-in-multi-out mode. To reach this purpose, in the contact structure 300, two RF layers 340 are stacked under the basic layer 330, and the static contact 331 of the basic layer 330 is electrically connected to the trace 341 of the RF layer 340. In FIG. 3, the contact static 331 is electrically connected to the trace 341 via two RF interconnections 401. Therefore, by the two moving contacts 311 and the two RF interconnections 401, the signals can be transmitted through a 2×2 variant, such as one-in-one-out, one-in-two-out, two-in-one-out and two-in-two out. Moreover, the control layer 350 is stacked under the RF layer 340 for providing logic and driving control of the actuators that make switching action. It can also include other non-RF functions as it separated by ground layers 342 between the RF layer 340 and the control layer 350.

In on example, two grounding interconnections 402 are used to connect the ground layer 342 located on a back surface of the basic layer 330 and the ground layer 342 located on a back surface of the RF layer 340.

In the aforementioned embodiment, the number of the moving contacts 311 and the RF interconnections 401 can be varied with different applications, thereby achieving multi-in-multi-out functionality.

In summary, this disclosure provides a contact structure for electromechanical switch utilizing PCB process and moving contact. Therefore, the volume of the electromechanical switch can be substantially minimized, the production and manufacturing cost of the electromechanical switch is low, various kinds of actuations can be allowed, various kinds of actuating devices can be matched, and the electromechanical switch has excellent performances, such as high isolation and low insertion loss. And the application range can be from DC to microwave.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A contact structure for an electromechanical switch, the contact structure is capable for transmitting signal having frequency higher than 1 GHz, the contact structure comprising:

a basic layer made of a printed circuit board and including a static contact made of a printed conducting path on an upper face;

a top layer made of a flexible circuit board and including a moving contact made of a printed conducting path;

a spacing layer sandwiched between the basic layer and the top layer wherein a thickness of the spacing layer defines a gap between the static contact and the moving contact and the static contact and the moving contact are parallel with each other, and at least one tuning circuit formed on the vicinity of the static contact and moving contact respectively;

wherein the moving contact and the static contact are micro strip lines and each of the static contact and the moving contact has a converging portion to render a minimum overlapping area to improve isolation;

wherein the moving contact is actuated to move and then contact the static contact for conducting a waveguide for transmitting high frequency signal and the tuning circuit compensates impedance variation induced between the moving contact and the static contact due to line width change.

2. The contact structure of claim 1, wherein a grounding structure is arranged at a lower surface of the basic layer.

3. The contact structure of claim 1, wherein a lead for packaging is arranged at the lower surface of the basic layer.

4. The contact structure of claim 1, further comprising:

a packaging structure for placing the contact structure therein, wherein the contact structure is connected to the packaging via wire bonding.

5. The contact structure of claim 1, wherein the top layer comprises a floating area made by a nick therein, and the moving contact is located on a lower face of the floating area.

6. The contact structure of claim 1, wherein the spacing layer is formed with a window through which the static contact of the basic layer is exposed to the moving contact of the top layer.

7. The contact structure of claim 1, wherein the converging portion of the static contact is a triangle with a spiky end.

8. The contact structure of claim 1, wherein the converging portion of the static contact is a triangle with a circle end.

9. The contact structure of claim 1, wherein the converging portion of the moving contact is a triangle with a spiky end.

10. The contact structure of claim 1, wherein the converging portion of the moving contact is a triangle with a circle end.

11. The contact structure of claim 1, wherein the converging portion of the static contact are formed from two portions with gradually reduced width.

12. The contact structure of claim 1, wherein the converging portion of the moving contact are formed from two portions with gradually reduced width.

13. An electromechanical switch having the contact structure of claim 1, comprising:

an actuation device coupled to the contact structure, comprising:

a supporting member fixed to the basic layer; and a transmission portion of the actuating device contacting the top layer having the floating area;

wherein a movement of the transmission portion drives the floating area to move downwardly and then pushes the moving contacts to contact the static contacts for allowing the microwave signal transmitted therein.

14. The electromechanical switch of claim 13, wherein the actuation device has electrostatic force, electromagnetic force, piezoelectric effect or heating effect.

15. The electromechanical switch of claim 13, wherein the actuation device comprises:

a printed coil constructed at the bottom of the basic layer; and a magnetic material constructed at the top of the top layer and coated over the printed coil;

wherein when a current is passed through the printed coil, the magnetic material makes the moving contacts move downwardly to contact the static contacts.

16. A contact structure for an electromechanical switch, the contact structure is capable of transmitting signal having frequency higher than 1 GHz, the contact structure comprising:

a top layer, wherein the top layers is made of a flexible circuit board and includes moving contacts made of printed conducting paths;

a basic layer, wherein the basic layer is made of a printed circuit board and includes a static contact made of a printed conducting path on an upper face;

a spacing layers sandwiched between the basic layer and the top layer, wherein the spacing layers defines a plurality of sub-spaces between the basic layer and the top layer, each of the moving contacts of the top layer is located in each of the sub-spaces, a thickness of the spacing layers defines a gap between the static contact and each of the moving contacts, and the static contact and each of the moving contacts are parallel with each other; and at least two RF layers stacked under the basic layer, wherein each of the RF layers is made of a printed circuit board and one of the RF layers includes a trace made of a printed conducting path on an upper face;

wherein the static contact of the basic layer is electrically connected to the trace of the RF layer by at least two RF interconnections; when each of the moving contacts of the top layer is individually or synchronously actuated to move and contact the static contact of the basic layer, at least a waveguide is produced for transmitting high frequency signals, and the high frequency signals are transmitted from the basic layer to the RF layers through at least one of the RF interconnections.

17. The contact structure claim 16, wherein each of the moving contacts of the top layer and the static contact of the basic layer are micro strip lines and each of the moving contacts of the top layer and the static contact of the basic layer have a converging portion respectively to render a minimum overlapping area to improve isolation.

18. The contact structure of claim 16, wherein at least one tuning circuit is formed on the vicinity of the static contact of the basic layer and each of the moving contacts of the top layer respectively, and the tuning circuits compensate impedance variation induced between each of the moving contacts and the static contact due to line width change.

19. The contact structure of claim 16, further comprising a control layer stacked under the RF layers for providing logic and driving control of an actuator that makes a switching action.

20. The contact structure of claim 16, wherein the basic layer comprises a ground layer located on a back surface thereof, one of the RF layers comprises a ground layer located on a back surface thereof, and the ground layer located on the back surface of the basic layer is electrically connected to the ground layer located on the back surface of the RF layer through at least two grounding interconnections.

* * * * *